US006016990A

United States Patent [19]

Small

[11] Patent Number: 6,016,990

[45] Date of Patent: Jan. 25, 2000

[54] ALL-WEATHER ROLL ANGLE MEASUREMENT FOR PROJECTILES

[75] Inventor: James G. Small, Tucson, Ariz.

[73] Assignee: Raytheon Company, Lexington, Mass.

[21] Appl. No.: 09/058,105

[22] Filed: Apr. 9, 1998

[51] Int. Cl.[7] ..... F41G 7/00; G01S 13/00

[52] U.S. Cl. ..... 244/3.11; 342/62

[58] Field of Search ..... 244/3.11, 3.14, 244/3.13, 3.21; 342/62, 188, 193, 103; 102/211, 213, 214

[56] References Cited

U.S. PATENT DOCUMENTS

| | | | |
|---|---|---|---|
| 4,030,420 | 6/1977 | Skagerlund | 102/211 |
| 4,388,867 | 6/1983 | Baumer | 102/211 |
| 4,979,696 | 12/1990 | Yff | 244/3.14 |
| 5,099,246 | 3/1992 | Skagerlund | 244/3.14 |
| 5,146,616 | 9/1992 | Tang et al. | 455/103 |
| 5,163,637 | 11/1992 | Hansen | 244/3.11 |
| 5,239,309 | 8/1993 | Tang et al. | 342/13 |
| 5,379,968 | 1/1995 | Grosso | 244/3.21 |
| 5,414,430 | 5/1995 | Hansen | 244/3.14 |
| 5,695,152 | 12/1997 | Levy | 244/3.13 |
| 5,855,339 | 1/1999 | Mead et al. | 244/3.11 |
| 5,896,106 | 4/1999 | Seidensticker et al. | 244/3.11 |

*Primary Examiner*—Theresa M. Wesson

*Attorney, Agent, or Firm*—David W. Collins; Andrew J. Rudd; Glenn H. Lenzen, Jr.

[57] ABSTRACT

A system for measuring the roll angle of a rotating projectile. The system includes a transmit system mounted on the projectile. The transmit system has a linearly polarized transmit antenna system, a first transmitter coupled to the transmit antenna system for transmitting a first transmit signal at a first frequency, and a second transmitter coupled to the transmit antenna system for transmitting a second transmit signal at a second frequency. The first frequency is different from the second frequency, and the first and second transmit signals are in phase coherency. The system further includes a receiver system located remotely from the projectile. The receiver system includes a linearly polarized receive antenna system for receiving the first transmit signal and the second transmit signal. A first receiver section is provided for receiving and downconverting the first transmit signal to provide a first receiver signal. A second receiver section is provided for receiving and downconverting the second transmit signal to provide a second receiver signal. The first and second receiver signals are in phase coherency. A roll angle processor is responsive to the receiver system for calculating the roll angle.

15 Claims, 9 Drawing Sheets

AIRCRAFT RADIATES A 2-FREQUENCY VERTICALLY POLARIZED SIGNAL; THE UP-SIGNAL, TO MULTIPLE USERS
70
PROJECTILE CONTAINS UP-SIGNAL RECEIVERS. COMPUTER, GPS RECEIVER
10A
FIRES THRUSTER
TARGET
80
GUN LANUCHES PROJECTILE

70
TRANSMITTER (16')
AERIAL PLATFORM
17'

RECEIVING ANTENNA
22
100MHz RECEIVER
24
200MHz RECEIVER
A/D
A/D
11
MICRO PROCESSOR
DATA
PROGRAM
10A
13
GPS RECEIVER
THRUSTER
14

ALL-WEATHER ROLL ANGLE MEASUREMENT FOR PROJECTILES

TECHNICAL FIELD OF THE INVENTION

This invention relates to techniques for tracking a spinning projectile or missile and determining its instantaneous roll angle while it is in flight.

BACKGROUND OF THE INVENTION

The purpose of this invention is to provide an all-weather, long-range control system for spinning command-guided projectiles. Such projectiles can be very low cost, since they do not require seekers or complex on-board computers for processing seeker information. Furthermore, a spinning projectile needs only a single deflection thruster to maneuver in any direction since the thruster can be fired at any appropriate roll angle. In operation, a projectile is launched and tracked during flight toward a predesignated target. When it is determined that accumulating errors will cause a miss, a single-shot thruster may be fired late in the flight to correct the trajectory errors.

Previous techniques to measure the roll angle of a projectile generally fall into one of several categories. One technique is to equip the projectile with a roll gyroscope and a data link to communicate its roll angle to the launch and flight control system. The approach is expensive since each projectile must carry an inertial navigation system, typically using gyroscopes, which must be hardened to withstand the large launch accelerations of a gun.

In another technique, the projectile is provided with a polarizing reflector for a radar or laser. The polarization angle of the received reflections indicates the roll angle, but this method suffers from an ambiguity of 180° in roll. The method is unable to distinguish up from down. Thus, half the time, the projectile will be commanded to thrust in the incorrect direction.

Another technique is to provide the spinning projectile with an optical sensor to discern the difference between sky and ground. This method is not all-weather and not very accurate.

In another technique, the projectile is imaged with a camera shortly after launch to determine its roll angle and remove the 180° ambiguity. Polarized reflections are then used to determine subsequent roll. This method will fail if the data stream is interrupted during flight by any obscuration such as smoke, dust etc.

SUMMARY OF THE INVENTION

The present invention is a significant simplification over the previous methods. It employs a simple CW radio transmitter carried on the projectile and a simple receiver processor (analog or digital) in the launch and flight control site to process the data necessary for determining the appropriate time to fire the thruster. The thruster is then commanded to fire by transmitting a brief signal from the control site to a command receiver onboard the projectile.

In accordance with one aspect of the invention, a system for measuring the roll angle of a rotating projectile is described. The system includes a transmit system mounted on the projectile. The transmit system has a linearly polarized transmit antenna system, a first transmitter coupled to the transmit antenna system for transmitting a first transmit signal at a first frequency, and a second transmitter coupled to the transmit antenna system for transmitting a second transmit signal at a second frequency. The first frequency is different from the second frequency, and the first and second transmit signals are in phase coherency. The system further includes a receiver system located remotely from the projectile. The receiver system includes a linearly polarized receive antenna system for receiving the first transmit signal and the second transmit signal. A first receiver section is provided for receiving and downconverting the first transmit signal to provide a first receiver signal. A second receiver section is provided for receiving and downconverting the second transmit signal to provide a second receiver signal. The first and second receiver signals are in phase coherency. A roll angle processor is responsive to the receiver system for calculating the roll angle.

In a preferred embodiment, the roll angle processor includes a summer device for summing the first receiver signal and the second receiver signal to produce a summed receiver output signal. The summed receiver output signal is processed to determine the instantaneous roll angle.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

This invention provides a new technique for tracking a missile, bullet or artillery round and determining the instantaneous roll angle of the spinning projectile while it is in flight. It uses a simple all-weather radio link to provide this information. This method of tracking and, specifically, of measuring the roll angle, provides the key enabling technology to implement a simple command-guided weapon control system. By measuring the roll angle of spinning projectiles very accurately, a single-shot thruster can be fired at a time calculated to permit correction to a projectile's trajectory, thus allowing accurate targeting on tactical targets. The system utilizes, in an exemplary embodiment, a simple cw (continuous wave) radio transmitter carried on the projectile, and a simple receiver and processor in the launch and control site to process the data necessary for determining the appropriate time to fire the thruster. The thruster is then commanded to fire by transmitting a brief signal from the control site to a command receiver onboard the projectile.

Figure 1:
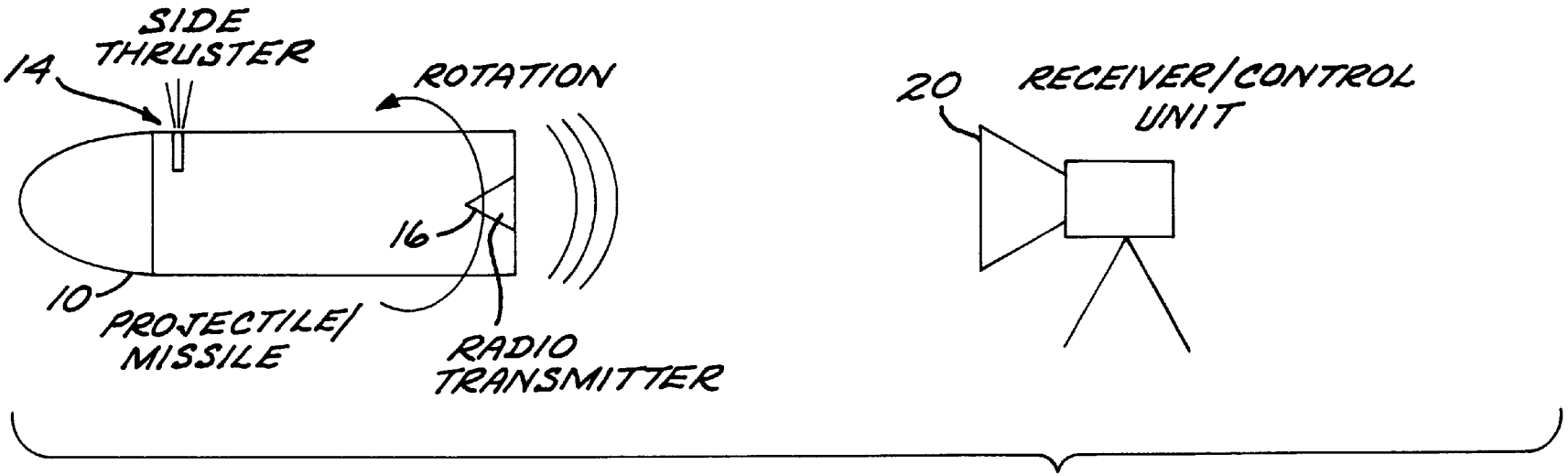
FIG. 1 is a simple diagrammatic view illustrating a spinning projectile and flight control site embodying aspects of the invention.
Figure 2:
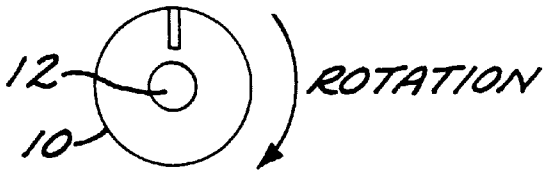
FIG. 2 is an end view of the projectile of FIG. 1.

A simple diagrammatic illustration of the problem to be solved by this invention is shown in FIG. 1. A projectile or missile 10 is in flight, and spins about its longitudinal axis 12 as illustrated in the projectile end view of FIG. 2. The projectile 10 includes a single side thruster 14 and a radio transmitter 16. A remotely positioned receiver and control unit 20 receives signals transmitted from the projectile, measures the roll angle of the projectile, and issues a transmitted command to fire the thruster 14 at the appropriate time.

Figure 3:
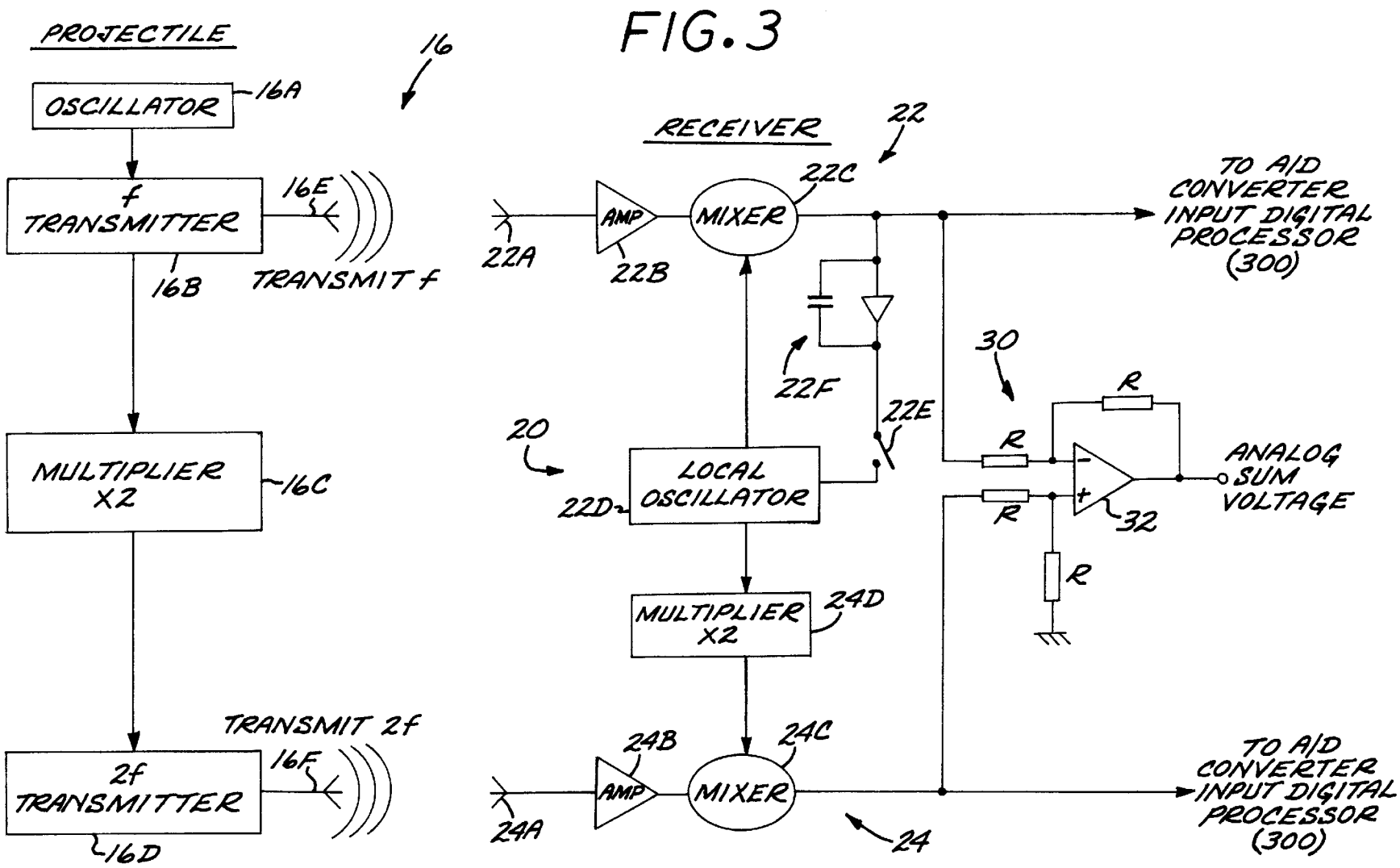
FIG. 3 is a simplified block diagram of an angle measurement system in accordance with the invention.

A simplified block diagram of an angle measurement system in accordance with the invention is shown in FIG. 3. The projectile transmitter unit 16 includes an oscillator 16A which generates a signal at frequency f, and a first transmitter 16B for transmitting a first signal at frequency f. In an exemplary embodiment, f is 100 MHz. The transmitter unit 16 further includes a frequency multiplier 16C for multiplying the frequency of the oscillator signal, to produce a signal at 2f. A second transmitter 16D transmits a second transmitter signal at frequency 2f, in this example 200 MHz. The transmitters 16B and 16D use an antenna to radiate the transmitted signals. While FIG. 3 shows separate antennas 16E and 16F, in a preferred embodiment, the two transmitters will share an antenna which will carry both transmitted signals. In accordance with an aspect of the invention, the antenna(s) is a linearly polarized antenna structure.

The receiver unit 20 is positioned at a remote site, typically at the projectile launch and control site, and includes two receiver sections for respectively receiving the two wireless signals transmitted by the projectile transmitters. While the receiver unit is illustrated in FIG. 3 as including two antennas 22A, 24A, in a preferred embodiment, the receiver sections will share a common linearly polarized antenna. The first receiver section 22 includes linearly polarized antenna 22A, which receives the first transmitted signal at frequency f. The received signal is amplified by amplifier 22B, and the amplified signal is mixed at mixer 22C with a local oscillator (LO) signal generated by LO 22D. The LO signal in this exemplary embodiment is 100 MHz plus 1 KHz, producing a mixer output signal at 1 KHz, which is provided to the processor.

The first receiver section also includes a switch 22E which connects/disconnects a phase locked loop circuit 22F from the LO and the mixer. This circuit is shown for illustrative purposes; one embodiment described below employed the circuit, while other described embodiments do not. Typically, the phase locked loop and the analog summing circuits are used only with analog processing.

The second receiver unit 24 receives the second transmitted signal with linearly polarized antenna 24A at frequency 2f, which is amplified by amplifier 24B and mixed at mixer 24C with a signal produced by multiplying the LO signal by two at multiplier 24D, i.e. by a signal at frequency 200 MHz plus 2 KHz. The output of the mixer 24C is therefore a 2 KHz signal. The output of the mixer 24C is also provided to the processor.

For purposes of illustration, the two transmitted frequencies are shown as 100 MHz and 200 MHz; but any two harmonically related frequencies may be used. In fact the invention is not limited to use with two harmonically related frequencies; non-harmonic but phase-coherent signals could be used with an appropriate signal processor. The two receivers of FIG. 3 produce two electrical output signals at frequencies of 1 KHz and 2 KHz, respectively.

With the switch 22E in the open position, as shown in FIG. 3, the receiver sections 22, 24 are conventional heterodyne receivers. The two output signals are replicas of the two received radio frequency signals in amplitude and phase, but the carrier frequencies have been shifted down from hundreds of MHz to a few KHz. If the receiver LO frequency drifts or if there are significant doppler shifts due to the fast moving projectile, these output frequencies may differ from 1 KHz and 2 KHz. Note however, that whatever the frequency of these two output signals, the two frequencies will always differ by exactly a factor of 2 and they will always have a definite relative phase relationship between them. This relationship is true because the two transmitted frequencies are derived from a common master oscillator 16A at the projectile transmitter unit 16 and the two receiver mixer injection signals are derived from a common Local Oscillator 22D at the receiver unit 20.

Figure 4A:
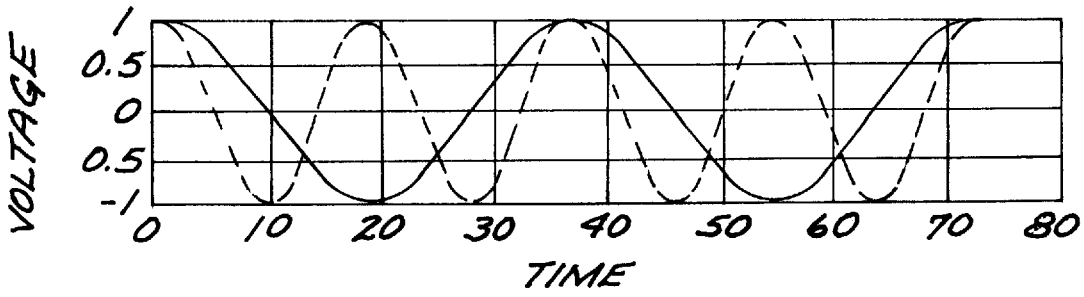
FIG. 4A shows the respective voltage waveforms of the first and second receiver signals provided by the receiver of FIG. 3.
Figure 4B:
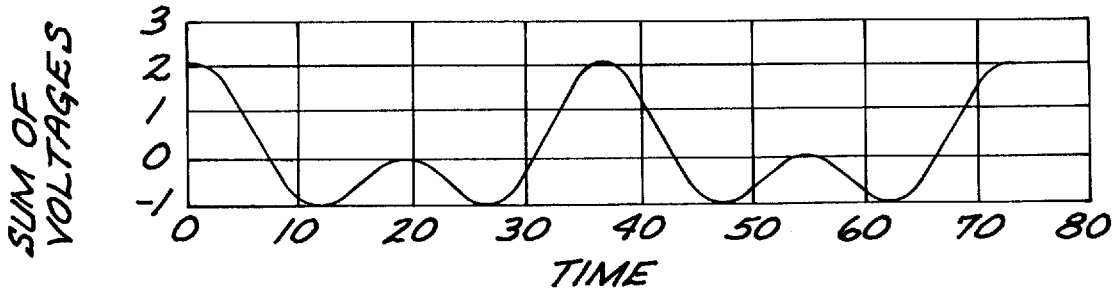
FIG. 4B shows the summed voltage of the summed signals of FIG. 4A as a function of time.

The output signals from the first and second receiver sections 22, 24 are summed in this exemplary embodiment by a summing apparatus, which can be done by a simple analog circuit or by a digital signal processor. FIG. 3 shows a conventional analog summing circuit 30 including an operational amplifier 32. FIG. 3 also indicates that the two receiver outputs are provided to a digital processor; this is an alternative arrangement to the analog summing circuit 30. When the two output signals are summed, they produce a beating waveform. This is shown in FIGS. 4A and 4B. FIG. 4A shows the respective voltage waveforms of the two signals (one solid line, one dotted line). FIG. 4B shows the summed voltage of the summed signals as a function of time. If the frequencies differ from 1 KHz and 2 KHz, this repeating waveform will still have the same shape. It will simply repeat at a different rate. Note that the waveform is asymmetric in amplitude. There is a large positive amplitude, shown here as 2 volts, followed by a smaller negative amplitude, shown here as −1 volt. This two-frequency waveform is the simplest example of a repeating nonsymmetric waveform. More complicated non-symmetric waveforms can be employed, such as repeating single-cycle impulse waveforms described in U.S. Pat. Nos. 5,146,616 and 5,239,309; but the two frequency case is simple and adequate for many applications.

Now consider what happens when the projectile 10 rotates during its flight. The linearly polarized transmitting antenna 16E/F will periodically become cross polarized with the fixed receiving antenna 22A/24A. The result is that the received signal strength in both receiver sections 22, 24 will be decreased from its maximum value. At a roll angle of 90°, the polarization will be completely orthogonal to the receiver and no signal will be received for a brief period.

At a roll angle of 180°, the received signals will once again be at maximum strength. However, each signal will be inverted in voltage with respect to the signal received at zero roll angle. Normally, a receiver could not detect such a difference. Each receiver is receiving a simple sinusoidal signal which produces electrical currents in the receiving antenna which alternate symmetrically between positive (+) voltage and negative (−) voltage at a rate of 100 MHz or 200 MHz.

Figure 5A:
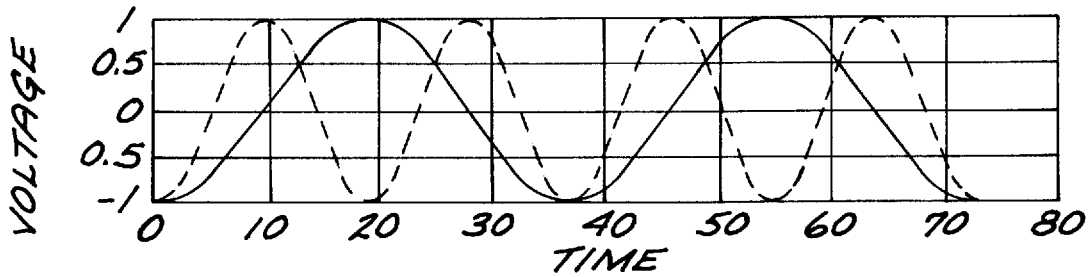
FIG. 5A shows in inverted form the first and second receiver signals of FIG. 4A.
Figure 5B:
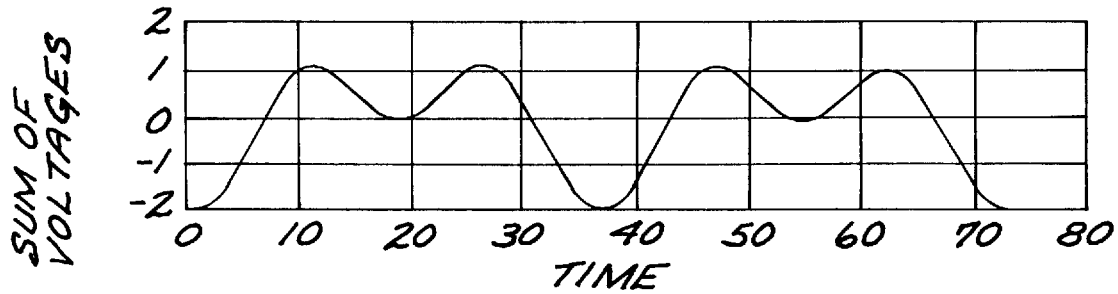
FIG. 5B shows the summed voltage of the summed signals of FIG. 5A.

Note however the summed voltage shown in FIG. 4B. If each voltage is inverted positive-to-negative, the resulting asymmetric waveform also inverts positive to negative. When the transmitting antenna rotates 180°, the summed receiver output voltages will also be inverted. The maximum voltage will now be −2 volts. FIG. 5A shows both the 1 kHz signal and the 2 kHz signal are voltage inverted. FIG. 5B shows the sum of the inverted signals of FIG. 5A. By comparing the largest positive and largest negative voltage excursions in the summed signal, it is possible to detect whether the projectile roll angle has exceeded 90°. In effect, the lower transmitted frequency acts as a pilot wave for phase information for the 2-times high frequency and removes the 180° ambiguity in the polarization of a rotating antenna.

There are various ways to process the receiver signals to extract the projectile roll angle. Three exemplary embodiments are described below.

In a first embodiment, the received signal in each receiver section (100 MHz and 200 MHz) varies in amplitude as the projectile rotates. Twice per rotation, the received signal goes to zero when the transmitted polarization is orthogonal to the receiving antenna polarization. These zeroes in received signal strength occur periodically at half the rotation period of the projectile. A Kalman filter or a phase-locked-loop is used to track these periodic zeroes and interpolate the rotation angle four times between zero crossings. The asymmetric summed signal is tested once or twice each rotation period and used to initialize the tracking filter to remove the 1800 roll ambiguity.

Since the analog voltages vary at relatively low audio frequencies, a digital processor can be employed, in which case the analog summing circuit 30 (FIG. 3) and phase locked loop 22E and 22F are not needed. The various tracking filters, summing of the receiver signals, and tests of voltage polarity can be implemented as software routines in the processor. For I.F. frequencies around 2 KHz, as shown in FIG. 3, the processor will have to sample the I.F. signals at a rate of 4 KHz or higher.

Figure 6:
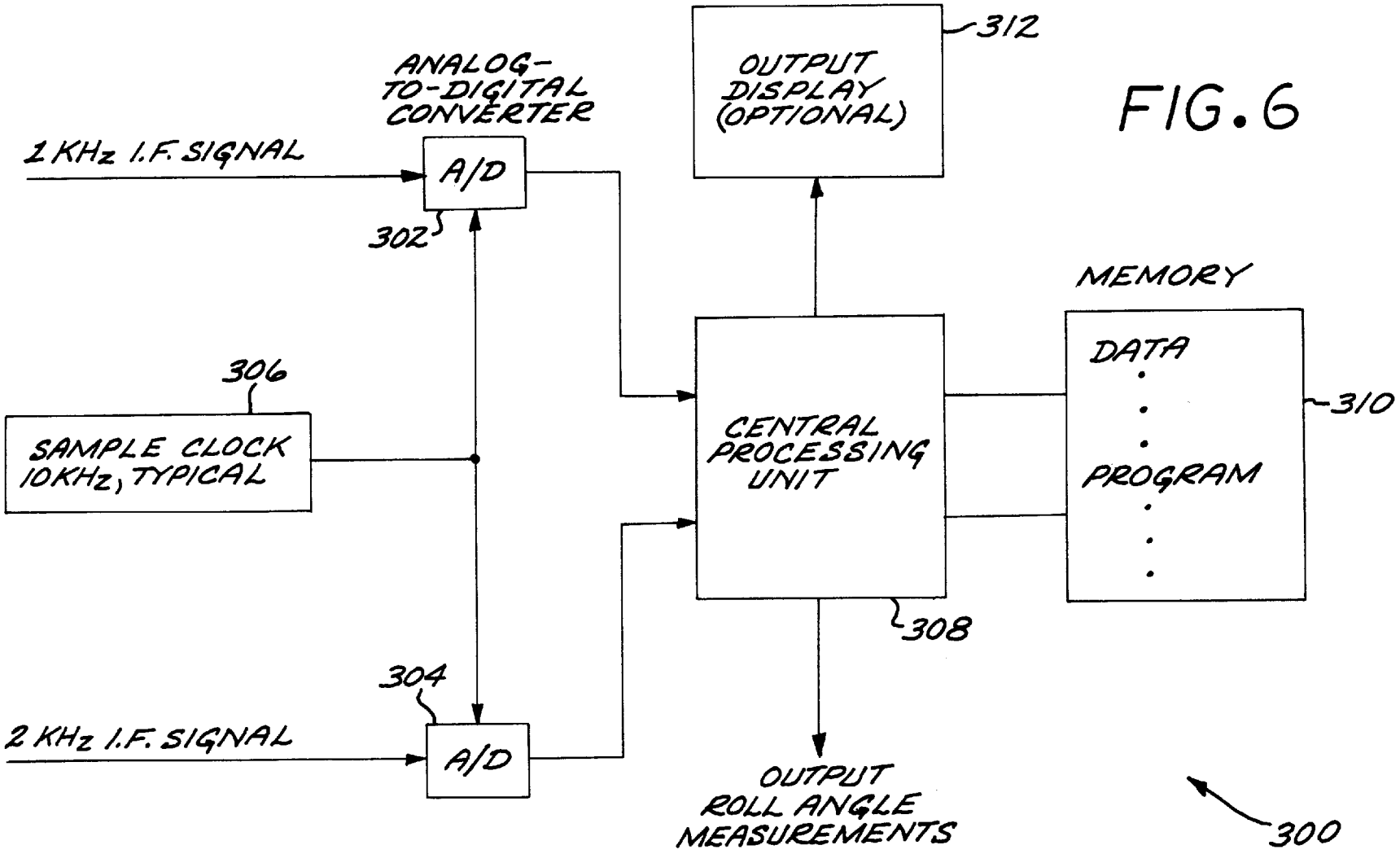
FIG. 6 is a schematic block diagram of a digital signal processor for processing the receiver signals of the system of FIG. 3.

An exemplary digital processor 300 is illustrated in schematic block diagram form in FIG. 6. The 1 KHz and 2 KHz I.F. signals are converted to digital form by respective analog-to-digital (A/D) converters 302 and 304, driven by a sample clock 306, e.g. at 10 KHz, and the digitized signals are input to a central processing unit (CPU) 308. The CPU can be a microcomputer, interfacing with a memory 312 in which is stored program instructions and data. The CPU processes the incoming signals, and provides as an output the roll angle measurements. An optional display 312 can display the output angle measurements, if desired for a particular application.

The Kalman filter and phase-locked-loop functions can be implemented as programs (resident in the memory 312) which operate on the data stream provided by the analog-to-digital converters. In this embodiment, a physical phase-locked-loop such as circuit 22F (FIG. 3) is not needed. Phase tracking is accomplished by computer analysis of the data stream.

Figure 7A:
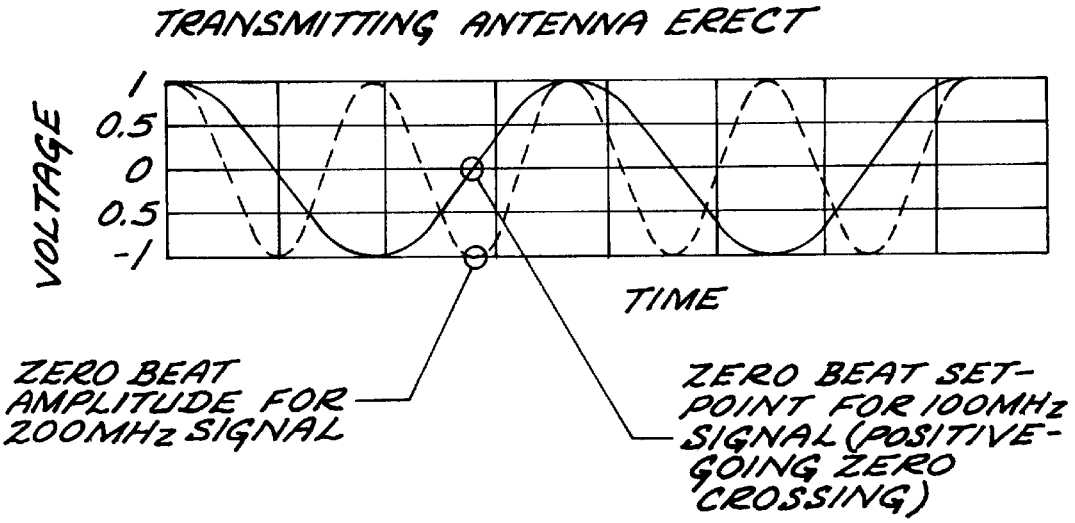
FIG. 7A shows the first and second receiver signals of a receiver employing a phase locked loop to track the zero beat of a first transmitted signal.
Figure 7B:
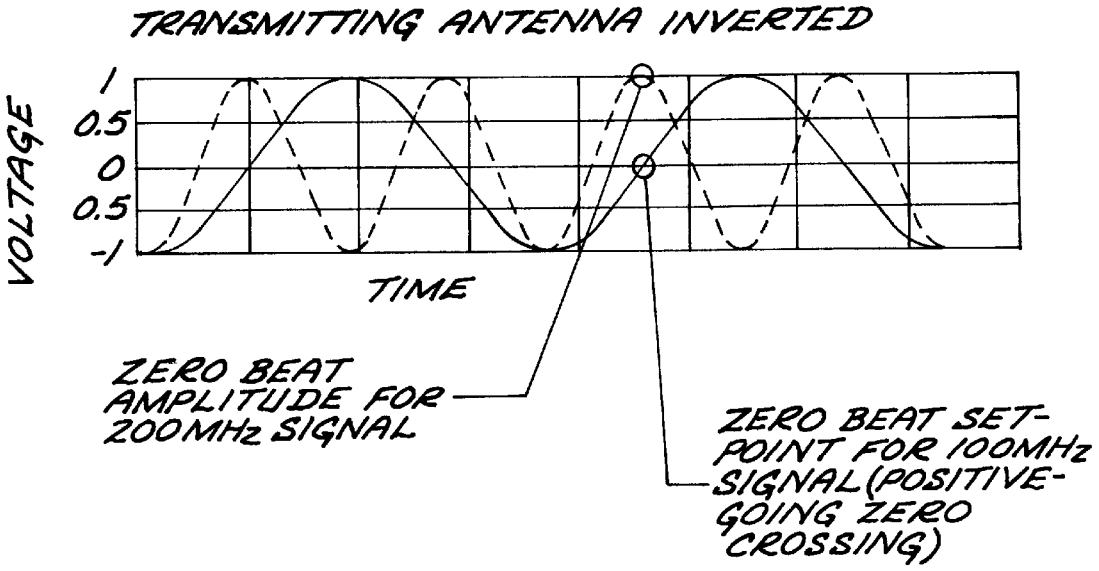
FIG. 7B shows the first and second receiver signals of FIG. 7A in inverted form.

In a second embodiment, the 100 MHz receiver section 22 is provided with a Phase Lock Loop (PLL) feedback circuit 22F to the receiver Local Oscillator 22D. This is shown conceptually by closing the switch 22E shown in FIG. 3 to complete the feedback loop. In this embodiment, the LO is a voltage-controlled variable frequency oscillator (VCO). The mixer signal is amplified, low-pass filtered, and applied to the LO voltage control input where it can continually adjust the LO frequency and phase. With the proper polarity and gain of this control signal, the local oscillator will change frequency in such a direction as to reduce the frequency of the mixer output signal. The 100 MHz receiver is electronically adjusted to exactly track the incoming 100 MHz signal. The I.F. signal then goes to zero beat; i.e. it assumes a constant DC voltage rather than the previous 1 KHz sinusoidal signal. Typically, the 100 MHz receiver section 22 is adjusted to track the positive-going zero crossing of the 100 MHz received signal. This is shown in FIG. 7A, which shows both transmitted waveforms, and FIG. 7B, which shows both inverted transmitted waveforms. PLL tracking is a common detection method typically used in receivers for frequency modulated signals. Other embodiments of phase tracking receivers are well known in the art, and could alternatively be employed.

When the 100 MHz receiver is in zero beat, the 200 MHz receiver section 24 will simultaneously be at zero beat and remain at a fixed phase angle relative to the 200 MHz received signal. From FIGS. 7A and 7B, it can be seen that the 200 MHz receiver section 24 will be tracking the point of maximum voltage in its received signal.

The receiver 24 output will be a DC signal which varies as the projectile rotates. As the projectile rotates away from the vertical, this maximum signal will decrease and go to zero at the moments of orthogonal polarization. As the projectile continues to rotate into an inverted position, the 200 MHz zero beat signal will begin to grow with a negative voltage. Thus, the 200 MHz zero beat signal will produce a sinusoidal output voltage which directly represents the cosine of the rotation angle. From this cosine voltage, the rotation angle may be readily calculated, e.g. by obtaining the arc-cosine of the 200 MHz zero beat signal normalized to the maximum value of this zero beat signal. The receiver must also be provided with a gain control compensation to account for signal strength decrease due to increasing range between the transmitting projectile and the receiver. Thus, in this embodiment with the PLL feedback circuit 22F in operation, voltages from the first and second receivers are not summed, since the receiver 24 directly produces a cosine signal which does not have the 180 degree ambiguity.

Figure 8:
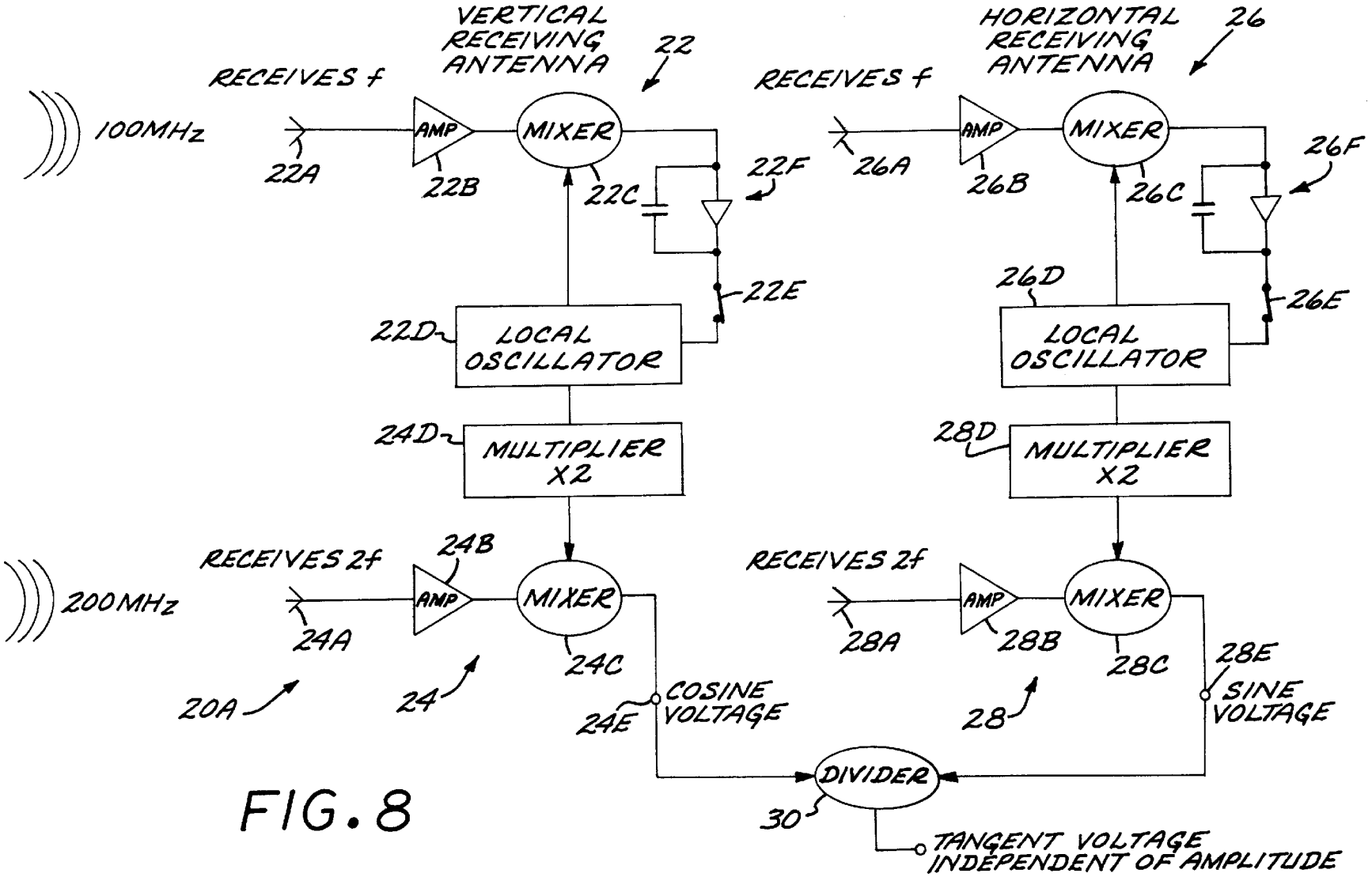
FIG. 8 is a simplified block diagram of a second alternative embodiment of a receiver system in accordance with the invention.

In a third preferred embodiment illustrated in FIG. 8, the receiver 20A is provided with additional second 100 MHz and second 200 MHz heterodyne receiver sections or channels. These duplicate receivers are attached to second receiving antennas which are cross-polarized to the first receiving antenna as shown in FIG. 8. Thus, the receiver 20A includes receiver sections 22 and 24 as in FIG. 3, and further includes receiver sections 26 and 28. Section 26 is the second 100 MHz receiver section, and section 28 is the second 200 MHz section. In this embodiment, the linearly polarized receive antennas 22A, 24A are oriented in the vertical direction, and the linearly polarized receive antennas 26A, 28A are oriented in the horizontal direction. The receiver section 26 includes amplifier 26B, mixer 26C, LO 26D, switch 26E and phase lock loop 26F. The receiver section 28 includes amplifier 28B, mixer 28C and multiplier 28D.

When in the zero beat condition, the first 200 MHz receiver channel 24 will produce at node 24E an output voltage which represents the cosine of the rotation angle. The second 200 MHz receiver channel 28 will produce at node 28E an output voltage which represents the sine of the rotation angle. The sine voltage is numerically divided by the cosine voltage from the first receiver at divider 30 to produce a tangent voltage signal which represents the rotation angle of the projectile. This tangent voltage signal depends only on the rotation angle. It is independent of the received amplitude of the 200 MHz signal, which amplitude also varies with the degree of cross polarization and distance of the transmitter from the receiver. From this tangent voltage signal, the projectile rotation angle may be readily calculated. This embodiment is less sensitive to signal fading than the second preferred embodiment.

Figure 9:
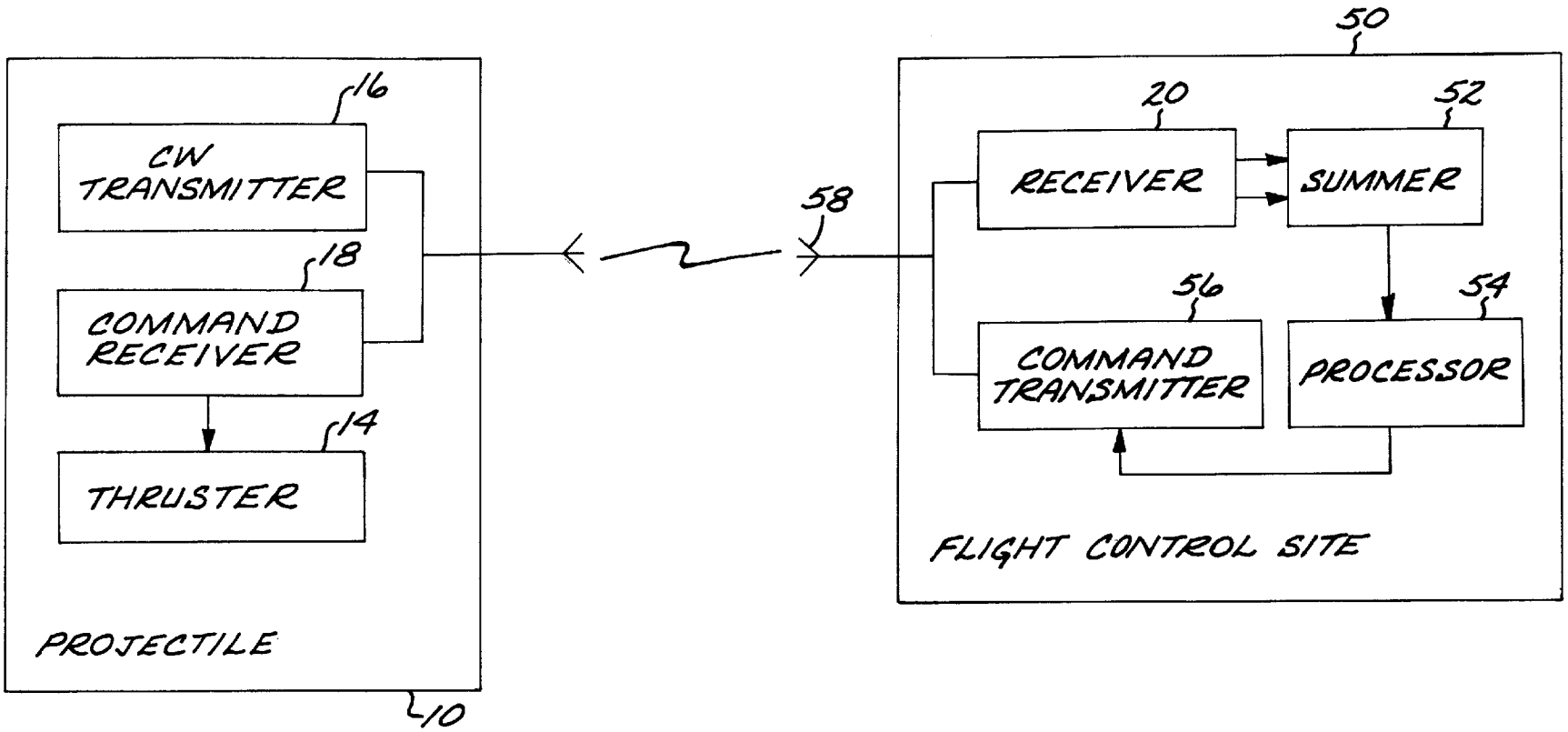
FIG. 9 is a conceptual signal processing flow diagram illustrative of the operation of the embodiment of FIG. 8.

FIG. 9 is a conceptual signal processing flow diagram illustrative of the operation of the embodiment of FIG. 8. In this case, the digital signal processor 300 will include D/A converters 302V, 304V for digitizing the receiver outputs from the vertical polarization receivers 22, 24, and D/A converters 302H, 304V for digitizing the receiver outputs from the horizontal polarization receivers 26, 28. The initial step (360) in the processing is to detect a positive-going zero crossing on either 100 MHz receiver 22 or 26. When such a zero crossing is detected, the processor records the vertical 2 KHz maximum amplitude, V1, from receiver 24 (step 362), and the horizontal 2 KHz maximum amplitude, V2, from receiver 28 (step 364). Next, at 366, the roll angle is computed as the are-tangent of V2/V1, i.e. the ratio value of V2 and V1. The computed roll angle data is output at 368.

This invention provides an all-weather, long-range control system for spinning command-guided projectiles. Such projectiles can be very low cost, since they do not require seekers or complex on-board computers for processing seeker information. Furthermore, a spinning projectile needs only a single deflection thruster to maneuver in any direction since the thruster can be fired at any appropriate roll angle. In operation, a projectile is launched and tracked during flight toward a predetermined target. When it is determined that accumulating errors will cause a miss, the single-shot thruster may be fired late in the flight to correct the trajectory errors.

Figure 10:
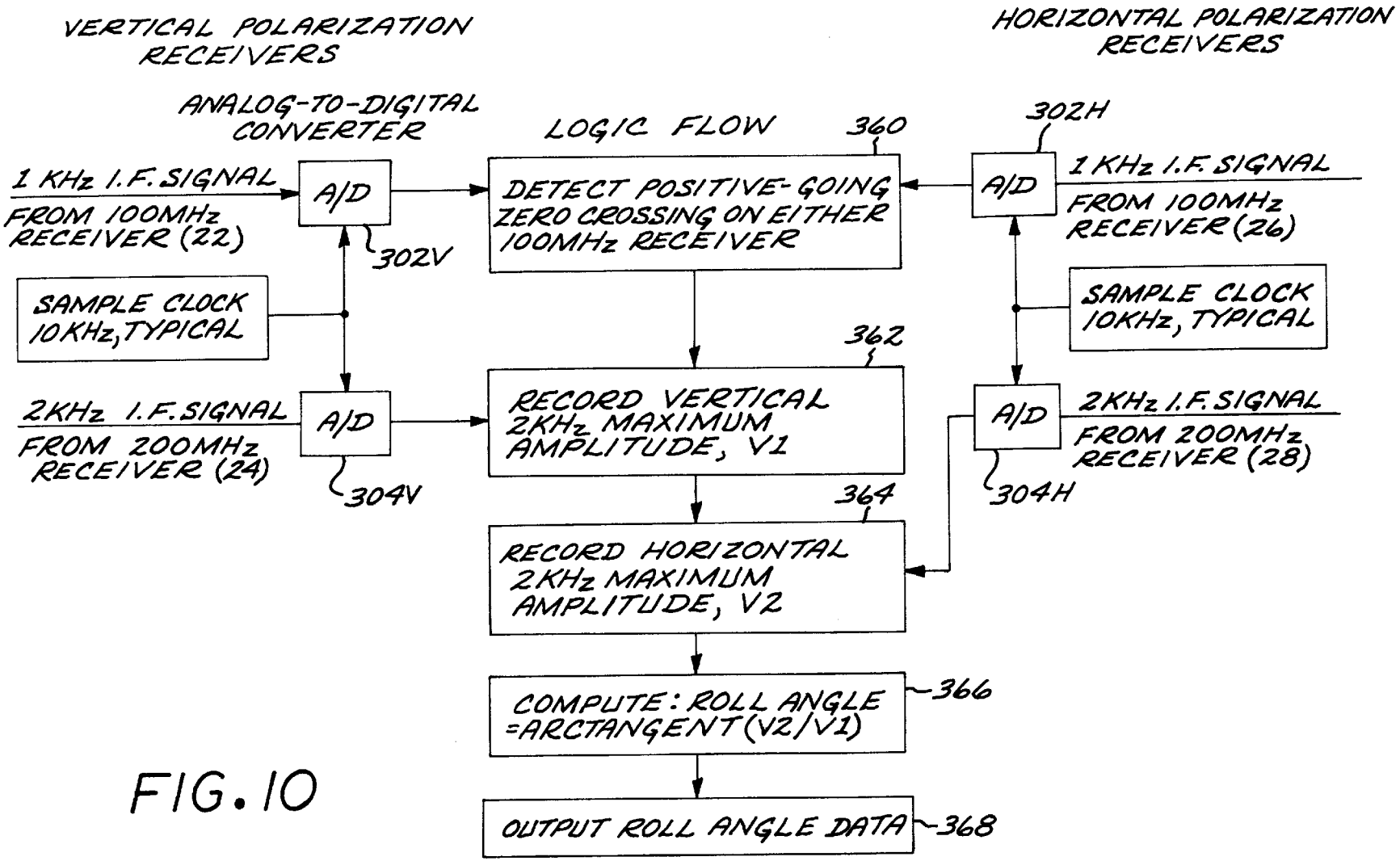
FIG. 10 is a simplified schematic block diagram of a command-guided projectile control system in accordance with the invention.

FIG. 10 is a simplified block diagram of a projectile control system embodying the invention. The projectile 10 includes the thruster 14, the cw transmitter 16, an antenna system 17, and the command receiver 18. The transmitter 16 and the receiver 18 share the antenna system 17 in this exemplary embodiment, although separate transmit and receive antennas can be employed in other embodiments. The flight control site 50 includes the receiver 20 and a summer 52 for summing the first and second output signals from the two receiver sections as in FIG. 3. A processor 54 is responsive to the summed signals for calculating the instantaneous roll angle of the projectile 10. A command transmitter 56 is responsive to control signals generated by the processor for transmitting thruster commands to the projectile. An antenna system 58 is shared by the receiver 20 and the command transmitter 56, although in an alternate embodiment, separate antennas can be employed for separate receive and transmit functions.

Figures 11A, 11B:
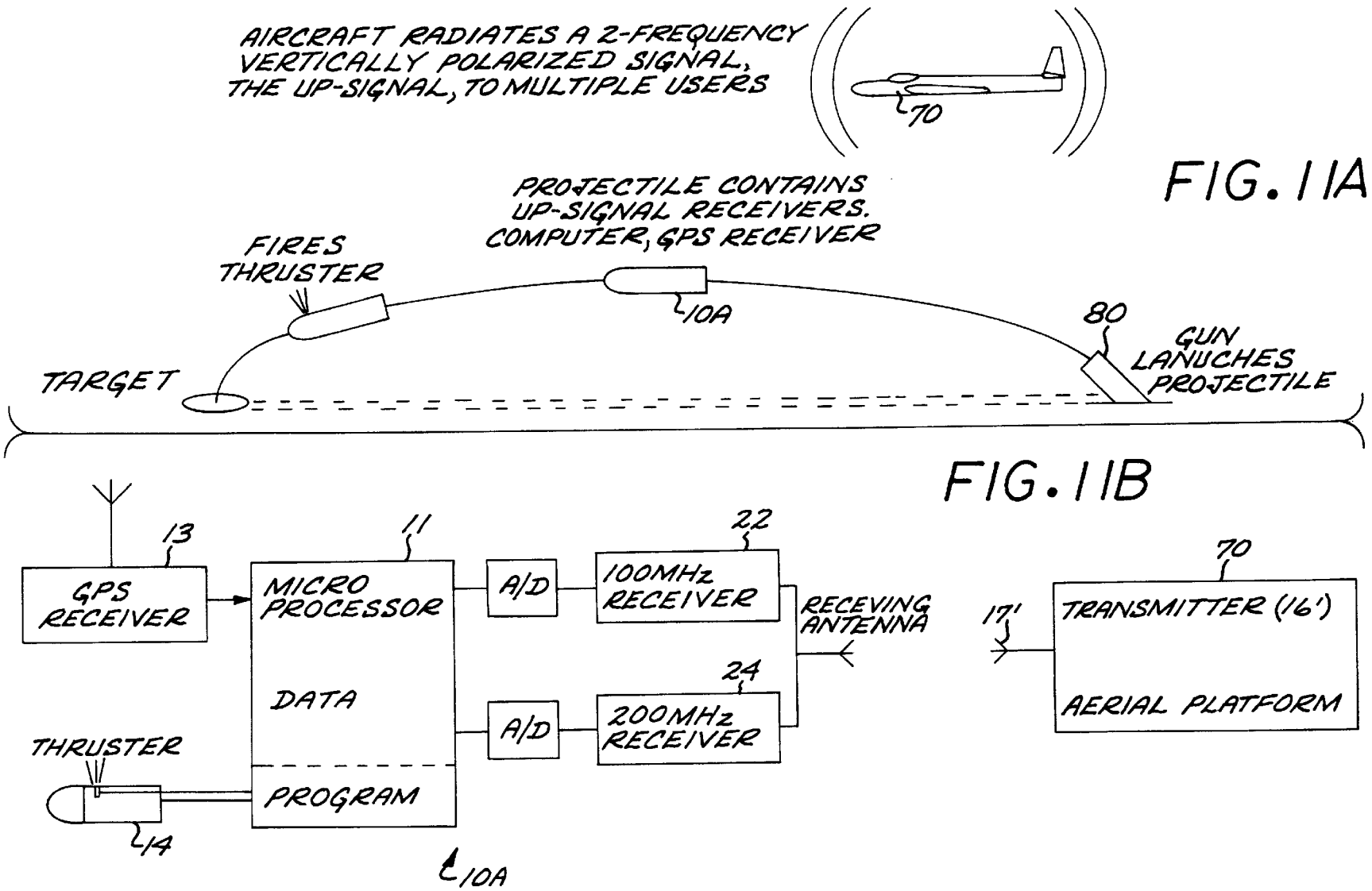
FIG. 11A is a simplified diagrammatic view of an alternate projectile control system in accordance with the invention.
FIG. 11B is a simplified schematic diagram of the projectile/missile of this system.

In an alternate embodiment of a projectile/missile control system in accordance with the invention which is illustrated in FIGS. 11A and 11B, the receivers 20, 22 are placed on the spinning projectile 10A. The 2-frequency transmitter 16' is placed on the ground or in an aerial vehicle 70. The transmitter 161 radiates via antenna 17 two coherent signals which are linearly polarized, to all interested users within radio line-of-sight of the transmitter 16'. For example, the two signals might be vertically polarized at frequencies of 100 MHz and 200 MHz, and are effectively an "up signal." The spinning projectile 10A can be provided with an on-board computer 11 and GPS receiver 13 to determine its position. By receiving the signals transmitted from the platform 70, the spinning projectile, within radio line-of-sight of the platform 70, can determine its rotation angle relative to the direction of linear polarization of the transmitted signals, i.e. with respect to vertical in the example. The projectile then has all the information needed to fire its thrusters 14. This implementation is much simpler than providing the projectile with an inertial navigation instrument. Also, no command link is needed between the controller, i.e. the shooter, and the projectile, thus avoiding a transmitted signal which can give away the shooter's position. With this embodiment, the projectile can autonomously measure its trajectory and correct deviations to hit its intended target. Before launch, e.g. by gun 80 the projectile is programmed with the GPS coordinates of the target. After launch, the projectile 10A uses the up-signal to measure roll angles without the need for an inertial navigation instrument.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A system for tracking the roll angle of a rotating projectile, comprising:

a transmit system mounted on the projectile, the system including a linearly polarized transmit antenna system, a first transmitter coupled to the transmit antenna system for transmitting a first transmit signal at a first frequency, a second transmitter coupled to the transmit antenna system for transmitting a second transmit signal at a second frequency, wherein said first frequency is different from said second frequency, and said first transmit signal and said second transmit signal are in phase coherency;

a receiver system located remotely from the projectile, the receiver system including a linearly polarized receive antenna system for receiving said first transmit signal and said second transmit signal, a first receiver section for receiving and downconverting said first transmit signal to provide a first receiver signal, and a second receiver section for receiving and downconverting said second transmit signal to provide a second receiver signal, wherein said first and second receiver signals are in phase coherency; and a roll angle processor responsive to said receiver system for calculating said roll angle.

2. The system of claim 1 wherein the roll angle processor includes a summer device for summing the first receiver signal and the second receiver signal to produce a summed receiver output signal.

3. The system of claim 1 wherein said first frequency and said second frequency are harmonically related.

4. The system of claim 1 wherein said receiver system includes an apparatus for tracking positive going zero crossings of said first receiver signal and determining the value of said second receiver signal at said zero crossings of said first receiver signal, and said roll angle processor is responsive to said second receiver signal value to determine said roll angle.

5. The system of claim 4 wherein said roll angle processor includes apparatus for calculating the arc-cosine of a normalized version of said second receiver signal value to determine said roll angle.

6. The system of claim 1 wherein the receiver system includes a local oscillator (LO) for generating an LO signal, a first mixer for mixing the received first transmit signal with the LO signal to downconvert the received first transmit signal to provide said first receiver signal, and a second mixer for mixing the received second transmit signal with the LO signal to downconvert the received second transmit signal to provide said second receiver signal.

7. The system of claim 6 wherein the LO is a voltage controlled oscillator (VCO), and said first receiver section comprises a phase locked loop circuit operating with the VCO, said phase locked loop circuit adapted to track positive going zero crossings of said first receiver signal.

8. The system of claim 1 wherein said roll angle processor includes a digital signal processor responsive to digitized versions of said first and second receiver signals, said digital processor adapted to track positive going zero crossings of said first receiver signal and determine the value of said second receiver signal at said zero crossings of said first receiver signal, said roll angle processor further adapted to calculate said roll angle in dependence on said second receiver signal value.

9. The system of claim 8 wherein the digital signal processor is adapted to determine an arc-cosine value of a normalized version of said second receiver signal value.

10. The system of claim 1 wherein:

said antenna transmit system comprises a first linearly polarized antenna system and a second linearly polarized antenna system, wherein said first and second antenna systems are mounted orthogonally with respect to each other, wherein said first receiver section and said second receiver section are responsive to signals received through said first antenna system; and said receiver system further includes a third receiver section and a fourth receiver section each responsive to signals received through said second antenna system, said third receiver section for receiving and downconverting said first transmit signal to provide a third receiver signal, said fourth receiver section for receiving and downconverting said second transmit signal to provide a fourth receiver signal, wherein said third and fourth receiver signals are in phase coherency.

11. The system of claim 10 wherein said roll angle processor includes apparatus for providing a signal representing a ratio value of said second and fourth receiver signals.

12. The system of claim 11 wherein said roll angle processor includes apparatus for determining said roll angle in dependence on an arc-tangent of said ratio value.

13. A system for controlling a rotating projectile, comprising:

a projectile having a thruster mounted thereon, and thruster control apparatus for controlling the firing of the thruster in response to thruster trigger signals, said thruster control apparatus including a command receiver for receiving thruster commands to fire said thruster;

a transmit system mounted on the projectile, the transmit system including a linearly polarized transmit antenna system, a first transmitter coupled to the transmit antenna system for transmitting a first transmit signal at a first frequency, a second transmitter coupled to the transmit antenna system for transmitting a second transmit signal at a second frequency, wherein said first frequency is different from said second frequency, and said first transmit signal and said second transmit signal are in phase coherency;

a receiver system located remotely from the projectile, the receiver system including a linearly polarized receive antenna system for receiving said first transmit signal and said second transmit signal, a first receiver section for receiving and downconverting said first transmit signal to provide a first receiver signal, and a second receiver section for receiving and downconverting said second transmit signal to provide a second receiver signal, wherein said first and second receiver signals are in phase coherency; and a flight controller responsive to said receiver system for controlling the projectile in flight, the flight controller adapted to calculate a roll angle of said projectile while in flight and generate a thruster command at an appropriate time in dependence on said roll angle, said flight controller further including a command transmitter for transmitting said thruster command to said projectile.

14. A system for controlling a rotating projectile, comprising:

a projectile having a thruster mounted thereon, and thruster control apparatus for controlling the firing of the thruster in response to thruster trigger signals;

a transmit system located remotely from the projectile, the transmit system including a linearly polarized transmit antenna system oriented in a reference direction, a first transmitter coupled to the transmit antenna system for transmitting a first transmit signal at a first frequency, a second transmitter coupled to the transmit antenna system for transmitting a second transmit signal at a second frequency, wherein said first frequency is different from said second frequency, and said first transmit signal and said second transmit signal are in phase coherency;

a receiver system mounted on the projectile, the receiver system including a linearly polarized receive antenna system for receiving said first transmit signal and said second transmit signal, a first receiver section for receiving and downconverting said first transmit signal to provide a first receiver signal, and a second receiver section for receiving and downconverting said second transmit signal to provide a second receiver signal, wherein said first and second receiver signals are in phase coherency; and a flight controller mounted on the projectile and responsive to said receiver system for controlling the projectile in flight, the flight controller adapted to calculate a roll angle of said projectile while in flight in relation to said reference direction and generate a thruster command at an appropriate time in dependence on said roll angle to control said thruster firing.

15. An all-weather, long-range control system for spinning command-guided projectiles, comprising:

a deflection thruster mounted on the projectile which can be fired at any appropriate roll angle in response to thruster command signals;

a continuous wave transmitter mounted on the projectile:

a command receiver mounted on the projectile;

an antenna system mounted on the projectile, the transmitter coupled to the antenna system to transmit wireless first and second transmit signals of first and second different frequencies, said transmit signals in phase coherency, via the antenna system, the command receiver coupled to the antenna system to receive thruster command signals and provide command signals to the thruster in response to signals received via the antenna system; and a flight control site including a receiver for receiving and downconverting the first and second transmit signals to provide first and second receiver output signals, a summer for summing the first and second receiver output signals, a processor responsive to the summed signals for calculating the instantaneous roll angle of the projectile and generating thruster control signals in dependence on the roll angle, and a command transmitter responsive to the control signals generated by the processor for transmitting thruster commands to the projectile.

* * * * *